US011421833B2

(12) United States Patent
Sharrah et al.

(10) Patent No.: US 11,421,833 B2
(45) Date of Patent: Aug. 23, 2022

(54) MULTIFUNCTION PORTABLE LIGHT AND ACTUATOR

(71) Applicant: STREAMLIGHT, INC., Eagleville, PA (US)

(72) Inventors: Raymond L. Sharrah, Collegeville, PA (US); Brandon Jay Rogers, Downingtown, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days.

(21) Appl. No.: 17/125,022

(22) Filed: Dec. 17, 2020

(65) Prior Publication Data

US 2021/0222842 A1 Jul. 22, 2021

Related U.S. Application Data

(60) Provisional application No. 62/963,233, filed on Jan. 20, 2020.

(51) Int. Cl.

| | |
|---|---|
| ***F21L 4/04*** | (2006.01) |
| ***F21V 23/04*** | (2006.01) |
| ***F21V 19/02*** | (2006.01) |
| ***F21V 17/10*** | (2006.01) |
| *F21Y 113/10* | (2016.01) |
| *F21Y 115/10* | (2016.01) |

(52) U.S. Cl.

CPC ..... *F21L 4/04* (2013.01); *F21V 17/107* (2013.01); *F21V 19/02* (2013.01); *F21V 23/0414* (2013.01); *F21Y 2113/10* (2016.08); *F21Y 2115/10* (2016.08)

(58) Field of Classification Search

CPC ..... F21L 4/04; F21V 17/107; F21V 19/02; F21V 23/0414

See application file for complete search history.

(56) References Cited

U.S. PATENT DOCUMENTS 4,057,794 A * 11/1977 Grossfield ..... G08B 21/04 174/67

6,874,908 B2 4/2005 Sharrah et al.

(Continued)

OTHER PUBLICATIONS

Streamlight, Inc., "CLIPMATE® USB Rechargeable, Compact Clip-On Light", printed Mar. 18, 2020, 2 pages, https://www.streamlight.com/products/detail/index/clipmate-usb.

(Continued)

*Primary Examiner* — Rajarshi Chakraborty
*Assistant Examiner* — Nathaniel J Lee
(74) *Attorney, Agent, or Firm* — Clement A. Berard, Esq.; Dann, Dorfman, Herrell & Skillman, PC

(57) ABSTRACT

A portable light may comprise: a light source including plural light emitting diodes (LEDs); a signaling light source; and plural actuators including: a first actuator for selecting of the plural LEDs; a second actuator coupling the selected LED for producing light; and a third actuator coupling the signaling light source to produce modulated light. A rotatable actuator thereof may comprise: a central cylindrical part of a tapered actuator member in a hollow cylindrical support with its wider base within the body and its narrower tip extending therefrom with the selector knob fixed thereto and rotatable therewith in the hollow cylindrical support, and an actuator ring around the hollow cylindrical support. A safety cover for an actuator may also be provided.

28 Claims, 8 Drawing Sheets

(56) References Cited

U.S. PATENT DOCUMENTS

| | | | | |
|---|---|---|---|---|
| D578,686 | S | 10/2008 | Dalton | |
| 7,466,082 | B1 | 12/2008 | Snyder et al. | |
| 7,534,975 | B1 | 5/2009 | Sharrah et al. | |
| 7,549,766 | B2 | 6/2009 | Sharrah et al. | |
| 7,581,847 | B2 | 9/2009 | Dalton | |
| D611,629 | S | 3/2010 | Sharrah et al. | |
| 8,727,561 | B2 | 5/2014 | Sharrah et al. | |
| 8,779,683 | B2 | 7/2014 | Snyder et al. | |
| 9,206,951 | B2 | 12/2015 | McLennan et al. | |
| 9,347,656 | B2 | 5/2016 | McLennan et al. | |
| D782,716 | S | 3/2017 | McLennan | |
| 10,151,433 | B2 | 12/2018 | McLennan et al. | |
| 10,378,744 | B2 | 8/2019 | Arena et al. | |
| 10,612,761 | B1 | 4/2020 | Worman et al. | |
| 2005/0040018 | A1* | 2/2005 | Gotoh | G05G 1/08 200/17 R |
| 2010/0046211 | A1* | 2/2010 | Spartano | F21L 4/045 362/157 |
| 2013/0220779 | A1 | 8/2013 | Kerner et al. | |
| 2015/0062886 | A1* | 3/2015 | Leegate | A42B 3/044 362/190 |
| 2015/0176782 | A1* | 6/2015 | McLennan | F21L 4/04 362/183 |
| 2016/0227620 | A1 | 8/2016 | Soles et al. | |

OTHER PUBLICATIONS

Streamlight, Inc., "CLIPMATE® USB Lithium Polymer Rechargeable Flashlight Product Fact Sheet", Document #182, Issued Dec. 19, 2013, Revised May 4, 2015, 1 page.

Princeton Tec, "Charge Pro—Tactical Helmet Light", © 2019, Printed Mar. 18, 2020, 2 pages, https://princetontec.com/product/charge-pro/.

Princeton Tec, "Point", Spec sheet, downloaded Mar. 3, 2021, 1 page, www.princetontec.com.

Princeton Tec, "Point MPLS", dated 2021, 2 pages, https://princetontec.com/product/point-mpls/.

Princeton Tec, "Switch Rail MPLS", dated 2021, 2 pages, https://princetontec.com/products/switch-rail-mpls.

Princeton Tec, "Switch Rail MPLS", Operating Instructions, © 2018, 2 pages.

Princeton Tec, "Point / Switch MPLS", Operating Instructions, © 2020, 2 pages.

Streamlight, Inc., "Streamlight Jr Reach LED-AA Battery Powered Flashlight", Data Sheet, 1 page, dated Dec. 2018, www.streamlight.com.

Streamlight, Inc., "Portable Light Having a Flexible Stalk", Design U.S. Appl. No. 29/718,340, filed Dec. 23, 2019, 31 pages.

International Searching Authority, "PCT—International Search Report & Written Opinion", PCT/US21/13078, dated Jun. 3, 2021, 12 pages.

* cited by examiner

RIGHT HANDED CLIP MOUNT

SECTION B - B

SECTION A - A

MULTIFUNCTION PORTABLE LIGHT AND ACTUATOR

This U.S. patent application claims the benefit and priority of U.S. patent application Ser. No. 62/963,233 filed Jan. 20, 2020, entitled "MULTIFUNCTION PORTABLE LIGHT HAVING A FLEXIBLE STALK," which is hereby incorporated herein by reference in its entirety.

The present invention relates to a portable light and, in particular, to a portable light and actuator. The invention also relates to a portable light having a flexible stalk.

Many portable lights are configured to provide lighting for various specific purposes, such as illumination, either in general or for a smaller space, or for signaling, e.g., identification friend or foe (IFF) signaling, and for various classes of users, e.g., consumers, professional, industrial, sport, military, police, fire, and the like. For some applications the portable light may include more than one of the foregoing, e.g., lights for fire fighters to provide bright illumination and an identification light, or lights for military where illumination and IFF features may be combined in one light.

Very few lights are configured to provide a wide variety of features that are useful to mixed classes of users. For examples, airplane and helicopter pilots, whether military or civilian, desire a light that provides general illumination and that also provides low level light in a color that minimizes loss of night vision. Other users wanting those features may also desire additional features, e.g., troops may also want their lights to also provide IFF signaling so as to identifiable by their comrades in arms.

Applicant believes there may be a need for a multifunction light that meets varying requirements and/or desires of different users and/or for a rotatable actuator therefor. In addition, there may also be a need for a method for assembling such light and/or actuator.

Accordingly, a portable light and actuator may comprise: A portable light may comprise: a light source including plural light emitting diodes (LEDs); a signaling light source; and plural actuators including: a first actuator for selecting of the plural LEDs; a second actuator coupling the selected LED for producing light; and a third actuator coupling the signaling light source to produce modulated light.

In addition, a portable light actuator may comprise: a central cylindrical part of a tapered actuator in a hollow cylindrical support with its wider base within the body and its narrower tip extending therefrom with the selector knob fixed thereto and rotatable therewith in the hollow cylindrical support, and an actuator ring around the hollow cylindrical support.

Further, a method for assembling a portable light actuator may comprise: obtaining a body having a hollow cylindrical support thereon; obtaining a tapered actuator member having a central cylindrical part that is smaller than an interior of the hollow cylindrical support; obtaining an actuator ring having an opening and having a radial paddle extending outwardly from the actuator ring; obtaining a selector knob that has a central opening therein; inserting the central cylindrical part of the tapered actuator member into the hollow cylindrical support; placing the actuator ring around the hollow cylindrical support; placing the selector knob onto the tapered actuator member; and fastening the selector knob to the tapered actuator member. The tapered actuator member and the selector knob may be captive in and rotatable together in the hollow cylindrical support, and the actuator ring may be captive on and rotatable around the hollow cylindrical support.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1C:
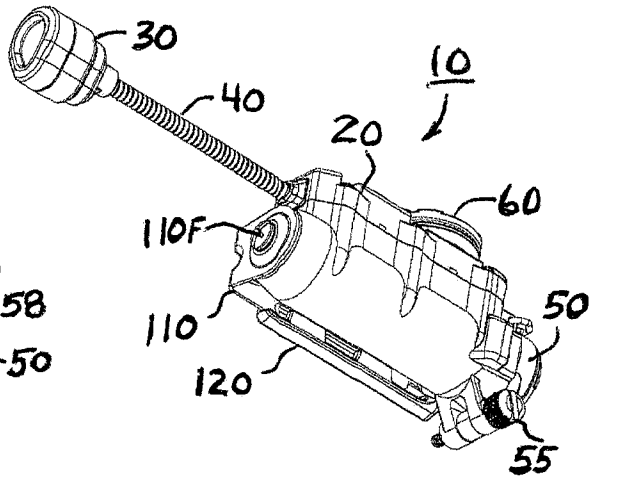
FIGS. 1A through 1F are perspective views of an example embodiment of a portable light and actuator having a flexible stalk.
Figure 1B:
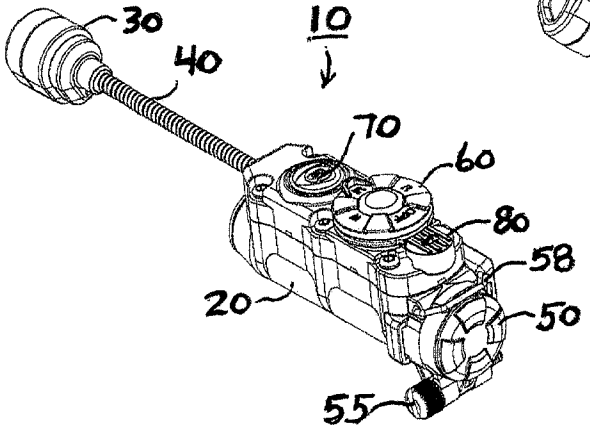
Figure 1A:
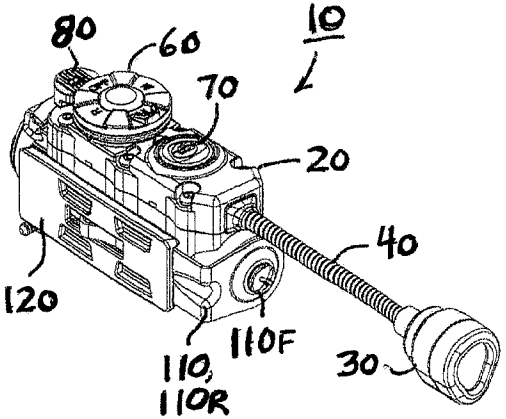
Figure 1F:
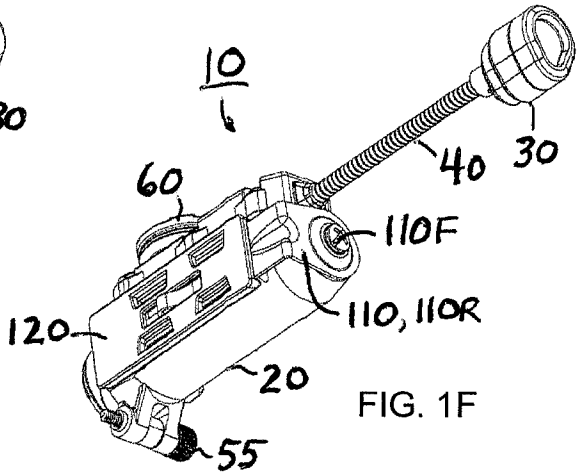
Figure 1E:
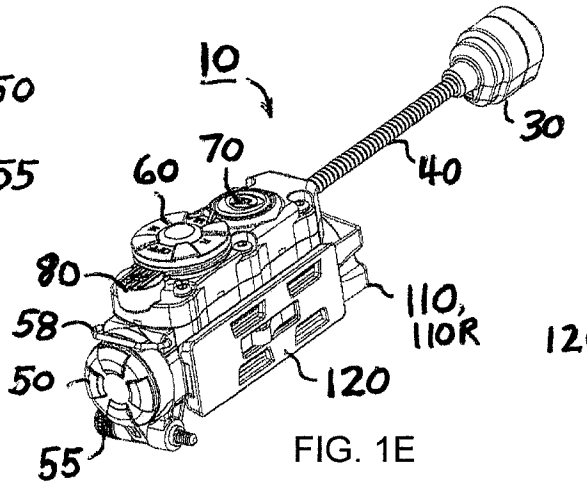
Figure 1D:
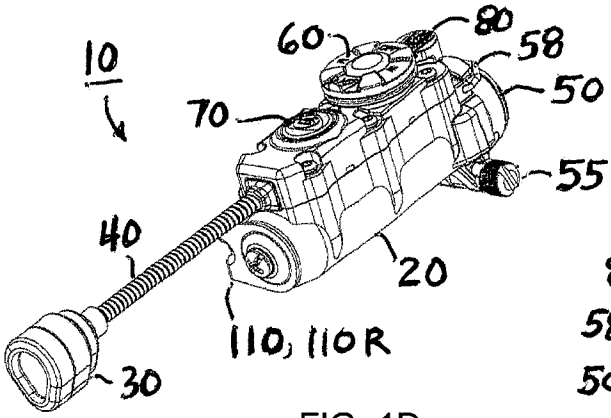

In the Drawing, where an element or feature is shown in more than one drawing figure, the same alphanumeric designation may be used to designate such element or feature in each figure, and where a closely related or modified element is shown in a figure, the same alphanumerical designation may be primed or designated "a" or "b" or the like to designate the modified element or feature. Similar elements or features may be designated by like alphanumeric designations in different figures of the Drawing and with similar nomenclature in the specification. As is common, the various features of the drawing are not to scale, the dimensions of the various features may be arbitrarily expanded or reduced for clarity, and any value stated in any Figure is by way of example only.

DESCRIPTION OF THE PREFERRED EMBODIMENT(S)

Figure 2D:
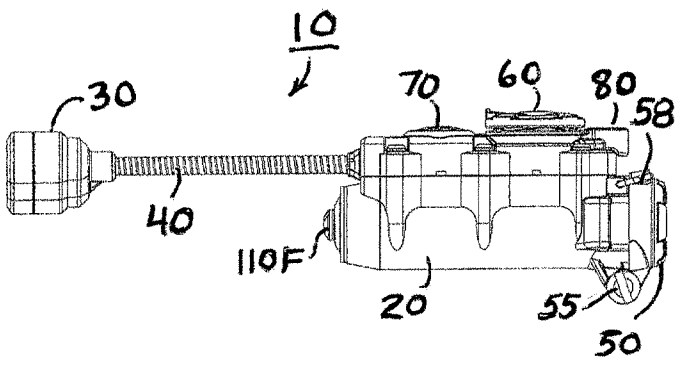
FIGS. 2A through 2D are side views of four sides of the example light and FIG. 2E is a view of an end thereof.
Figure 2E:
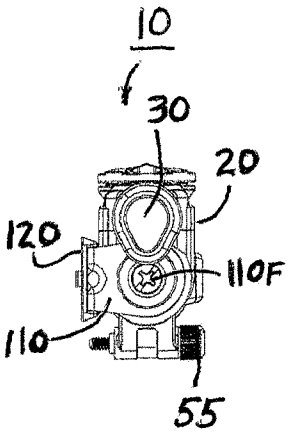
Figure 2A:
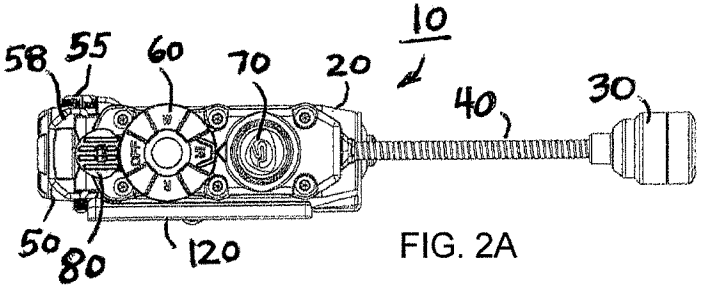
Figure 2B:
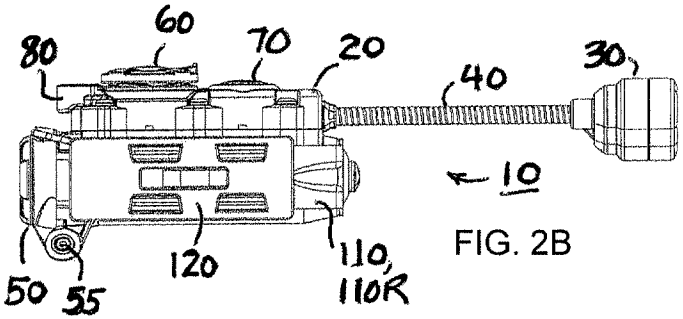
Figure 2C:
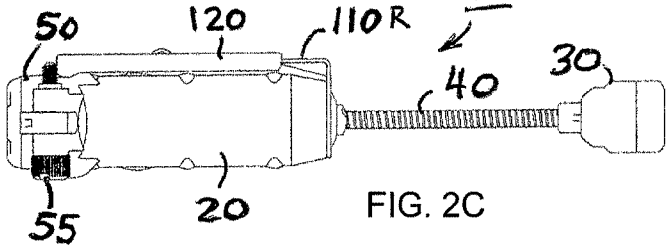
Figure 3B:
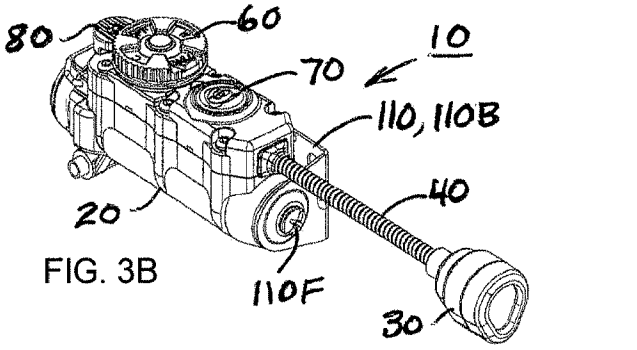
FIGS. 3A through 3C are perspective views and FIGS. 3D through 3F are side views of three sides of the example light and FIG. 3G is a view of an end thereof.
Figure 3E:
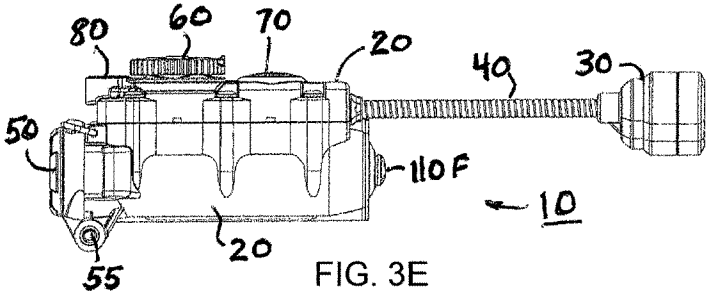
Figure 3F:
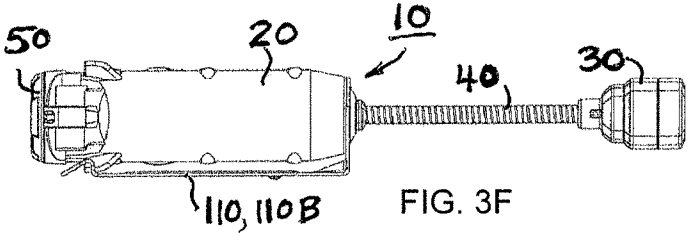
Figure 3G:
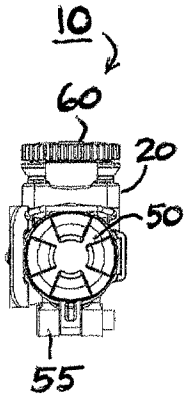
Figure 3A:
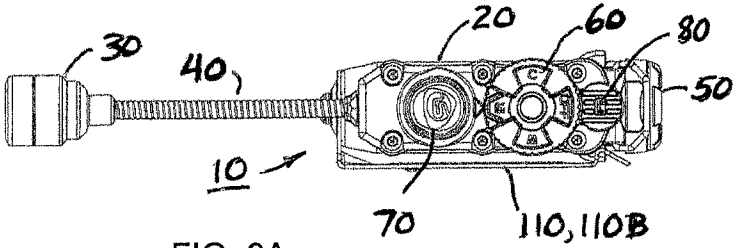
Figure 3D:
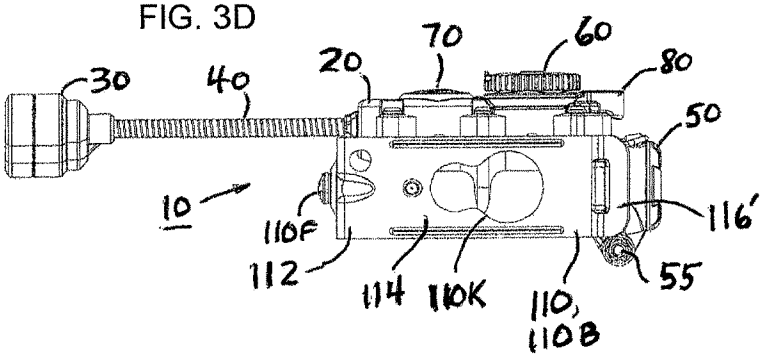
Figure 3C:
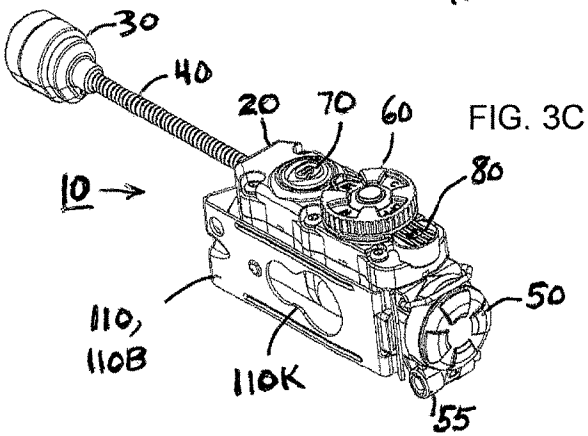

FIGS. 1A through 1F are perspective views of an example embodiment of a portable light 10 and actuator 60, 80 having a flexible stalk 40; FIGS. 2A through 2D are side views of four sides of the example portable light 10 and FIG. 2E is a view of an end thereof and FIGS. 3A through 3C are perspective views and FIGS. 3D through 3F are side views of three sides of the example light 10 and FIG. 3G is a view of an end thereof. Portable light 10 is considered to be a truly "multi-function" light because it includes plural light sources, e.g., five or more different light sources, that provides several different colors of light, light at different brightness levels, light usable for different purposes, e.g., illumination, personal work lighting, infrared (IR) illumination and IR identification friend or foe (IFF) lighting, and light directed in different directions, wherein one direction is fixed relative to the light body 20 and the others are in directions defined by a user bending flexible stalk 40 to a desired direction.

Portable light 10 is also multi-function in that it includes plural control actuators 60, 70, 80, e.g., three actuators, for independently controlling the plural light sources of light 10. For example, one actuator 60, e.g., a rotatable actuator 60, provides mode selection among different operating modes that enables a user to select which of the plural light sources of light head 30 is to be turned ON and OFF responsive to operation of ON/OFF switch 70. In addition, ON/OFF switch 70 may provide plural actuation modes, e.g., momentary ON, continuous ON and OFF. In effect, rotating mode selection actuator 60 to the OFF position disables ON/OFF actuator 70, e.g., to prevent accidental or unintentional actuation of any of the LEDS of light head 30.

In addition, portable light 10 is further multi-functional in that actuator 80 also provides for user selection and control over other operating modes. An example actuator 80 is rotatable from a center position at which one of the light sources of light 10, e.g., an IFF light source 220, is OFF, as well as being movable to left and right positions whereat ones of the light sources of light 10 are enabled and/or turned ON, e.g., an IFF light source that emits IR light which includes a modulated identification signal thereon, through a lens located centrally on rotatable actuator 60. Optionally, the OFF position of either of actuators 60, 80 may be configured to provide a "lock out" mode wherein all of the light sources are precluded from being turned on by any other actuator.

Portable light 10 is further multi-function in that it may be hand held and/or attached to various objects, e.g., clothing, webbing, a helmet mount, a helmet rail, another object, and the like. To that end, portable light 10 may include an easily changeable clip 110 that facilitates such attachments.

Clip 110 may be one of a set of compatible clips 110, 110R, 110B. For example, the illustrated clip 110, 110R has an end distal its attachment to light body 20 that engages a feature of light body 20 and is configured to receive mount or adapter 120 which is configured for mounting light 10 to a helmet mounting rail, e.g., an accessory rail connector (ARC) rail adapter which is used on the military helmets. An advantage of this mounting arrangement is that light 10 has a low profile, e.g., is held close to the helmet, to reduce the likelihood of certain objects, e.g., strings and ropes, snagging or becoming entangled on light 10.

Another clip 110, 110B is for providing, e.g., a belt or pocket clip, and either of clips 150 may have a keyhole shaped opening for engaging on the post of a helmet mount, e.g., such as the helmet mount described in U.S. Pat. No. 7,581,847 entitled "Clip On Clip Off Mounting Device, as for a Portable Light" and U.S. Design Pat. D-578,686 entitled "Mounting Device," each of which are hereby incorporated herein in their entirety.

Any of the clips 150, 110R, 110B may be mounted to the left side or to the right side of light body 20 of light 10, primarily by removing the fastener 110F from the forward end of light body 20, removing the clip 150 from its present position, placing the clip 150 or another clip 150 in its new intended position, and reinstalling fastener 110F.

For example, the portable light 10 as illustrated in FIGS. 1A-1F and FIGS. 2A-2E have a rail mount clip 110, 110R and rail adapter 120 that is mounted at the left side of light 10 whereas portable light 10 as illustrated in FIGS. 3A-3F have a belt clip 110, 110B that is mounted at the right side of light 10

Light body 20 of portable light 10 has a battery cover 50 that is openable to place, remove and replace a battery 90 in a cavity therein, and closable to retain the battery 90 therein. Another multi-function aspect of portable light 10 is that it is a "dual fuel" light in that it can operate using batteries or at least two different sizes and/or battery chemistries, e.g., an AA size battery and a CR-123 size battery. Single use lithium batteries are typically utilized, but rechargeable batteries may also be utilized, as may alkaline and other batteries if lesser performance, e.g., a shorter operating time, can be tolerated.

Battery cover 50 is hinged to light body 20 by a dual function threaded fastener 55 that provides a pin for the hinge for battery cover 50 and is intentionally longer than needed for that purpose so that it can be threaded into a mounting rail, e.g., a helmet rail, for securely retaining light 10 thereon. Hinge pin fastener 55 may be removed and threaded into position as a hinge pin from either side of light body 20, thereby providing for both right hand and left hand mounting of light 10, e.g., to a helmet rail or other rail. Hinge pin fastener 55 may have a shaft that is threaded only at its end distal from its head and may have a smooth shaft between the head and the threaded part. One or more of the clevis loops of light body 20 and/or cover 50 that align to receive hinge pin fastener 55 may have internal threads so that fastener 55 when threaded therethrough is captive and so is less likely to become misplaced.

Portable light 10 has a light body 20 from which extends a flexible stalk 40 at the distal end of which is a light head 30. Light head 40 includes one or more light sources, e.g., light emitting diodes (LEDs), that may be operated together or individually to provide desired light that can be directed from light head 30 in various different directions by merely bending flexible stalk into a different shape to point light head 30 in a desired direction.

In a preferred embodiment, light head 30 has a "teardrop" shaped cross-section wherein a first light source, e.g., a higher power LED, may be located near the center of a circle part of which defines the larger part of that cross-section and a second light source below that in the narrower part of the cross-sectional shape. In one example thereof the first light source of light head 30 may include an LED that includes plural LED devices, e.g., white, red, green and blue LEDs, in a common package. The white LED thereof may be, e.g., of relatively higher power, for providing general illumination, whilst the other LEDs, e.g., red, green and blue colored LEDs, may be of relatively lower power for providing personal work space lighting, particularly, lighting at a low light level and in a color that does not significantly affect, e.g., night vision.

Additionally, and optionally, but preferably, light head 30 may include a second light source, e.g., an IR LED, for providing IR illumination as may be desirable as a source of infrared light usable in conjunction with night vision equipment.

Also additionally and optionally, portable light 10 may be programmable and may be programmed to illuminate a predetermined one of the plural colored LEDs of light head 30. Under one option, e.g., light 10 may be factory and/or dealer programmable, whereby apparently distinct products, e.g., a red light, a green light, and so forth, may be offered to customers based upon a single lighting product, e.g., a light product having plural LEDs of different colors and/or brightness levels, thereby reducing the quantity and cost of maintaining sufficient inventory.

Under another option, the programmability may be made accessible to a user, whereby the user need only acquire a single portable light 10 having a full complement of LED light sources and may then reprogram the light to function as, e.g., a red light, a green light, and so forth, as circumstances and/or user desires may warrant. The TEN-TAP® programmable control feature available in lights from Streamlight, Inc. of Eagleville, Pa., provides such user controllable programming.

Programming the modes and/or other operations of light 10 is typically accomplished by the pressing the ON/OFF actuator 70 plural times and/or within a time and/or for a time and/or in certain sequences. For example, one example may be that light 10 could be programmed such that one actuation of actuator 70 when the light 10 is OFF will turn the light selected by mode selector actuator 60 ON. Another example could be that light 10 could be programmed such that plural actuations of actuator 70 within a predetermined time will turn that LED ON in a predetermined manner, e.g., at a different brightness level, or, e.g., in a flashing or blinking or strobing mode. Alternatively, light 10 could be programmed such that holding ON/OFF actuator 70 pressed for an extended time, e.g., 2-3 seconds, could be utilized to change the operating mode in a predetermined manner, e.g., at a different brightness level, or, e.g., in a flashing or blinking or strobing mode.

Figure 4:
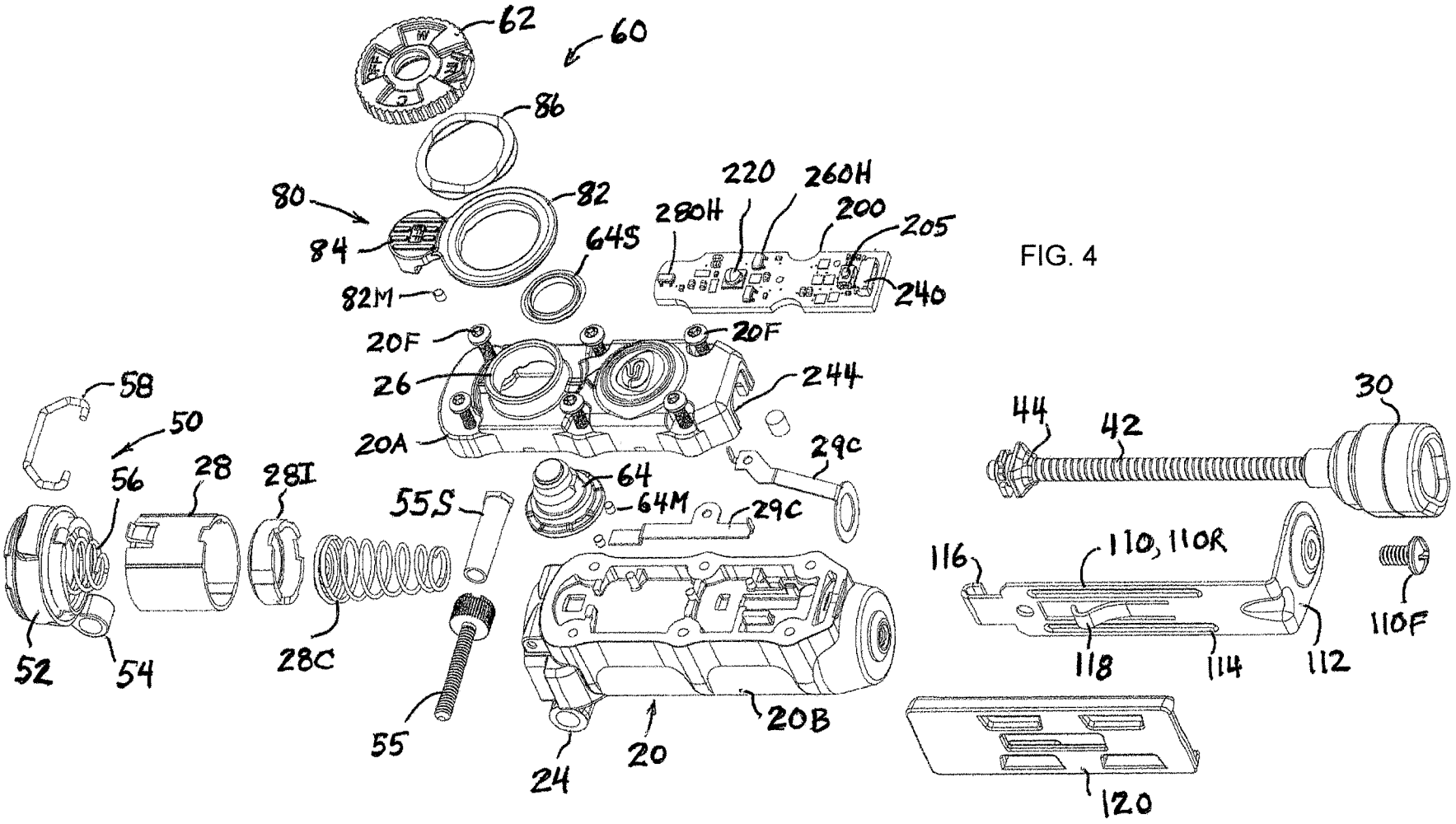
FIG. 4 is an exploded view of the example portable light as shown in FIGS. 1A-1F and 2A-2E.
Figure 5B:
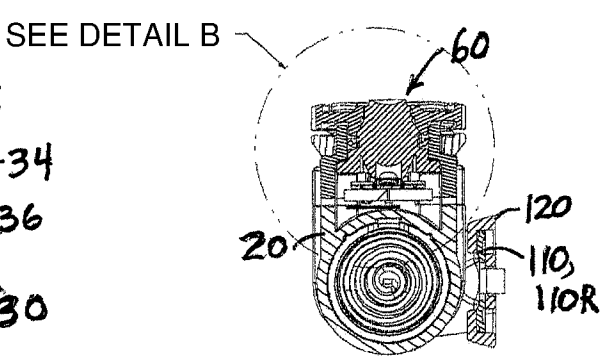
FIG. 5B is a transverse cross-sectional view of the example portable light.
Figure 5C:
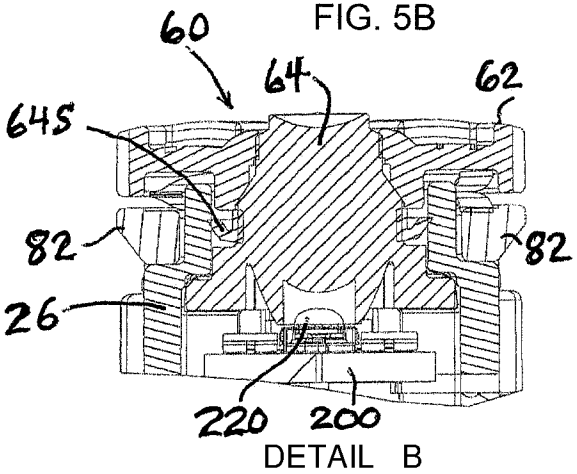
FIG. 5C is an enlarged detail of the mode selector actuator portion thereof.
Figure 5:
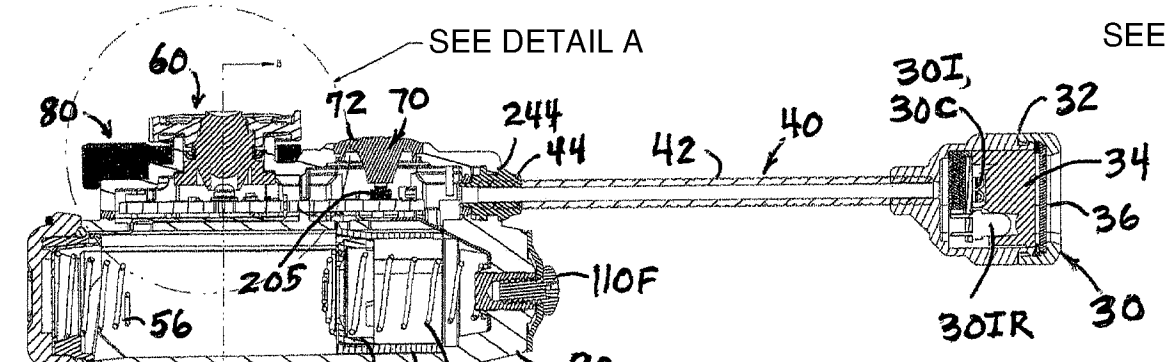
FIG. 5 is a longitudinal cross-sectional view of the example portable light.
Figure 5A:
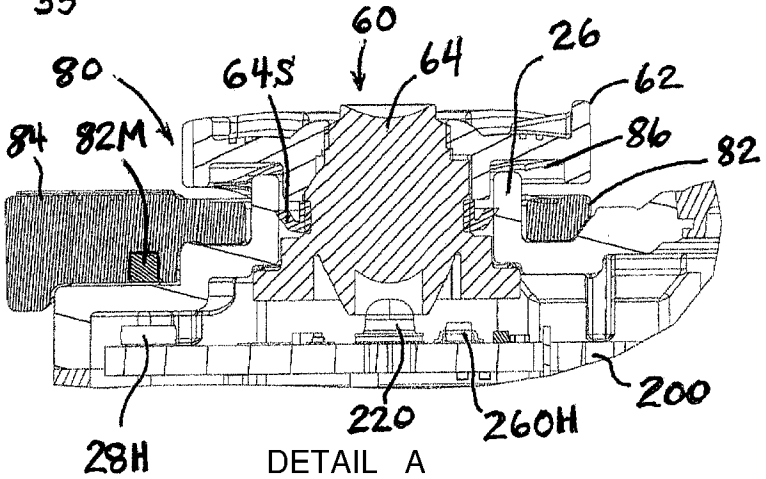
FIG. 5A is an enlarged detail of the mode selector actuator portion thereof.
Figure 5D:
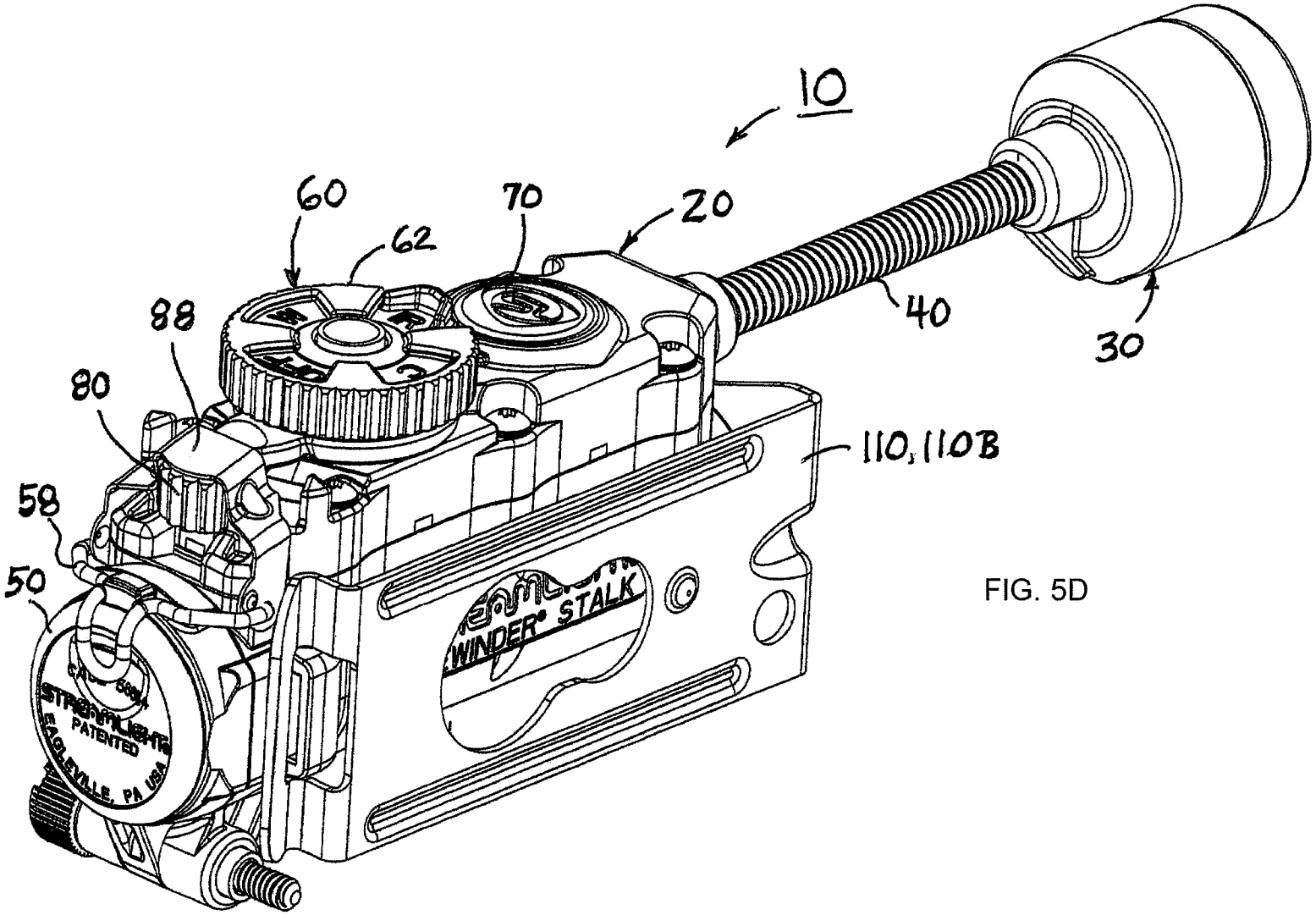
FIGS. 5D and 5E are rear perspective views of the example portable light with a safety cover.
Figure 5E:
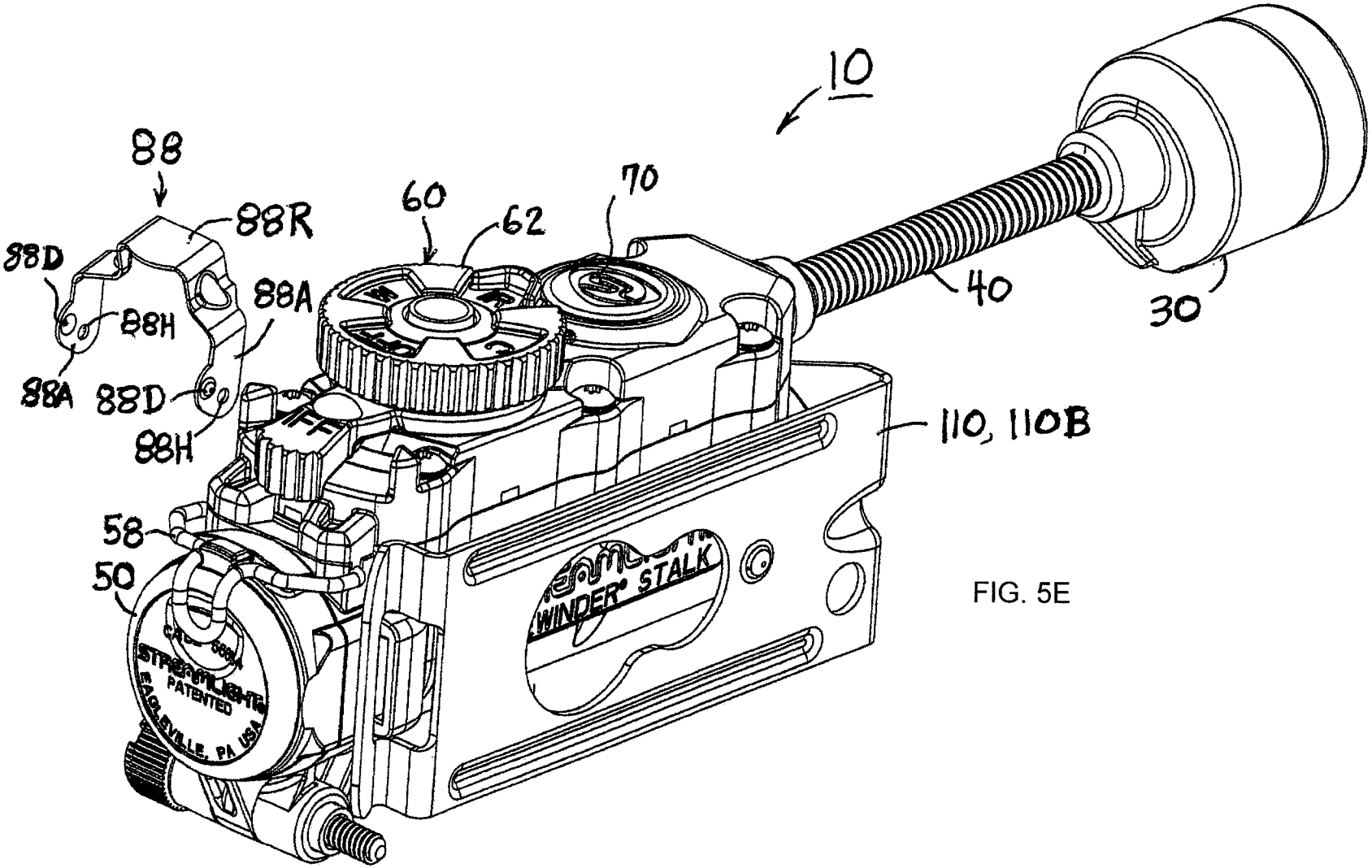
Figure 6:
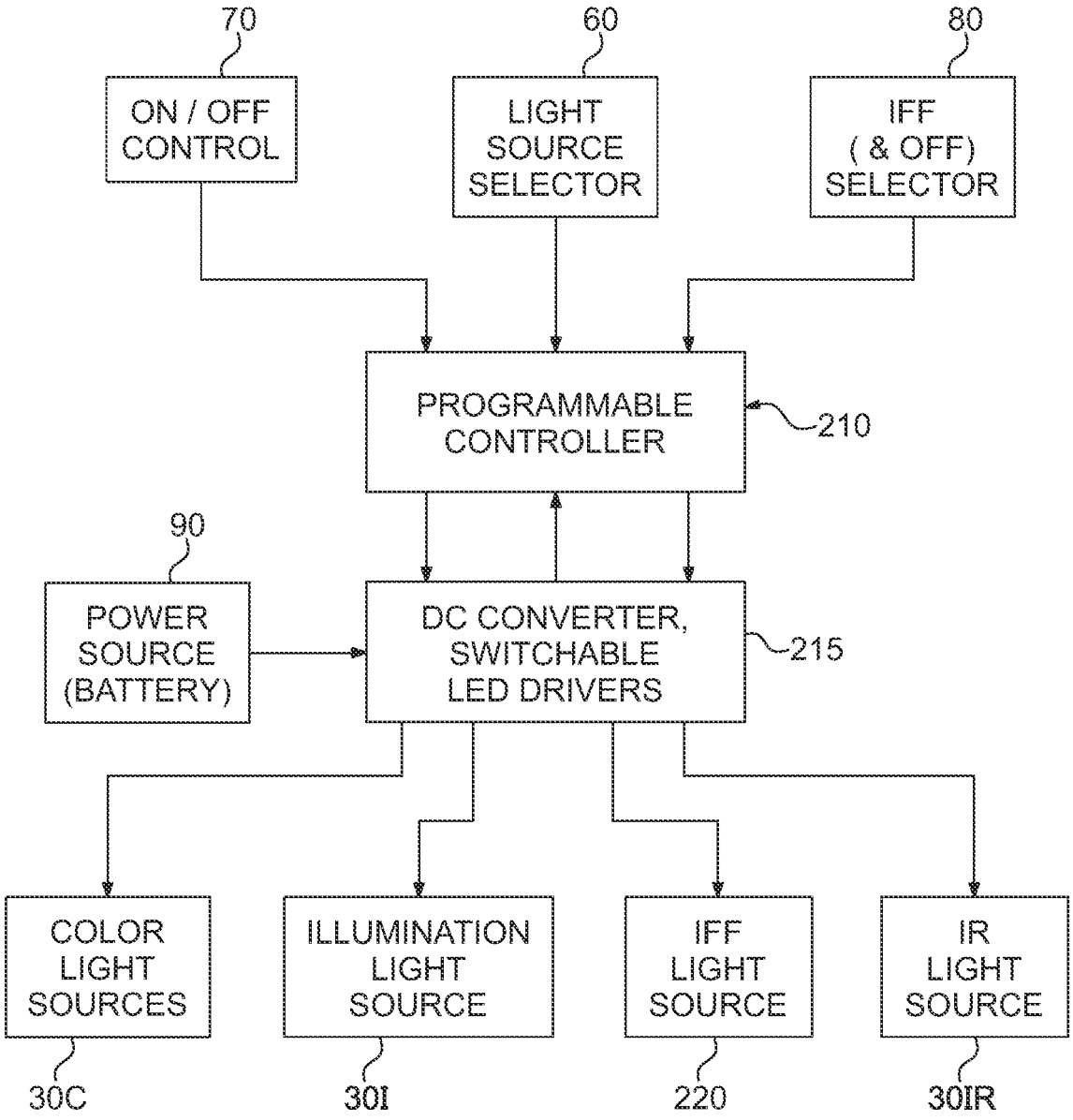
FIG. 6 is a schematic block diagram of the example portable light.

FIG. 4 is an exploded view of the example portable light 10 of FIGS. 1A-1F and 2A-2E; FIG. 5 is a longitudinal cross-sectional view of the example portable light 10, FIG. 5A is an enlarged detail of the mode selector actuator 60 portion thereof; FIG. 5B is a transverse cross-sectional view of the example portable light 10, FIG. 5C is an enlarged detail of the mode selector actuator 60 portion thereof; FIGS. 5D and 5E are rear perspective views of the example portable light 10 with a safety cover 88; and FIG. 6 is a schematic block diagram of the example portable light 10.

Light body 20 comprises upper and lower light body housings 20A, 20B, respectively, wherein upper light body 20A contains the various actuators 60, 70, 80 and lower light body housing 20B has an internal cavity for receiving a source of electrical power 90, e.g., a battery 90 that is accessible and is retained therein by cover 50. Upper and lower light body housings 20A and 20B are retained against each other by plural fasteners 20F, thereby capturing circuit board 200 therein and capturing and retaining the base 44 of stalk 40 in the receptacle 244 of upper light body housing 20A.

Forward battery contact spring 82 is disposed in the battery cavity of housing 20 as are an outer sleeve 28 and inner sleeve 821 for providing an arrangement for receiving and positioning, and making electrical connection to the forward end of, the battery 90 when placed therein. In particular, inner sleeve 821 adapts (shortens) the cavity for the shorter length battery 90, e.g., a CR-123 battery, while having an inner diameter suitable for receiving a smaller diameter battery 90, e.g., a size AA battery, therein. Contact spring 56 of battery cover 50 makes electrical connection to the rearward end of the battery 90.

Battery cover 50 includes a cover body 52 that supports battery contact spring 56 and a latch 58 for retaining the battery 90 in light body 20. A hinge clevis 54 extends from cover 50 to complement the hinge clevis 24 that extends from light body 20 and to be engaged by hinge sleeve 55S to provide a hinge for battery cover 50. Hinge pin fastener 55 extends through the hinge, e.g., through sleeve 55S thereof, for securing light 10 to a helmet rail.

Flexible stalk 40 includes a flexible shaft, e.g., a helically wound hollow flexible shaft, that has a base 44 at one end as described and light head 30 at the other end thereof. Flexible shaft 40, 42 has a plurality of electrical conductors therein for conducting electrical power to the LEDs within light head 30. Where light head 30 includes a combination LED 30I, 30C having, e.g., white, red, green and blue LED chips therein, four electrical conductors, e.g., one for each LED, and a common electrical conductor are provided, for a total of five electrical conductors. Where an IR LED 30IR is provided in light head 30, an additional electrical conductor will be provided therefor. The common conductor may be, e.g., for power or ground. The flexible shaft 42, if electrically conductive, may be utilized to provide one of the electrical conductors.

In an example embodiment, combination LED 30I, 30C may be generally centrally disposed in the larger part of light head body 32 and light head 30 while IR LED 30IR may be disposed in the smaller part thereof. A common lens 34, e.g., a totally internally reflective (TIR) optic, or a separate lens and reflector, may be provided for carrying light from LEDs 30I, 30C, 30IR forward out of light head 30, which has a seal 36 for light head body 32 at the exposed face of optic or lens 34.

Circuit board 200 within light body 20 includes an IFF light source, e.g., IFF LED 220, where provided, one or more Hall-effect sensors 260H for detecting the positions of magnets 64M of mode selector 60 for determining the position to which mode selector 60 has been rotated, and one or more Hall-effect sensors 280H for detecting the positions of magnets 82M of IFF actuator 80 for determining the position to which IFF selector actuator 80 has been rotated. Circuit board 200 also contains means 240, e.g., a connector 240 or other connection device 240, for receiving and making electrical connection to the electrical conductors that exit the hollow shaft 42 of flexible stalk 40 through the base 44 thereof.

Actuator 60 comprises an assembly of various parts. IFF lens structure 64 is optically clear and formed to both pass light from IFF LED 220 on circuit board 200 to exit through the concave dome at the upper end of lens structure 64. Lens structure 64 is inserted into and seated in a hollow cylindrical selector support 26 which extends from upper light body 20A. Lens structure 64 is inserted from inside of upper light body 20A, e.g., prior to circuit board 200 being placed therein, and before light body housings 20A and 20B are attached to each other. Seal 64S may be placed over lens structure 64 either before or after it is placed into support 26.

Actuator ring 82 of actuator 80 is placed on support 26 with ring 82 thereof surrounding the exterior of support 26. Wavy spring 86 is placed over support 26 or into the underside of selector knob 62 before selector knob 62 is placed onto the upper end of lens structure 64 and is affixed thereto, e.g., by adhesive, heat welding, ultrasonic welding or the like. Thus, selector knob 63, lens structure 64 and selector actuator 80 are all affixed in support 26 of upper housing 20 and are rotatable therein, with selector knob 62 and lens structure 64 being rotatable independently of actuator 80. Selector knob 62 is rotatable without restriction in either direction, e.g., CW and CCW, while actuator 80 is rotatable over a limited angular range.

Recessed and/or raised features, e.g., recesses and/or projections, of the respective surfaces of each of selector knob 62 and actuator ring 82 that abut wavy spring 86 are engaged thereby to provide independent detents for the respective independent rotations of actuators 60 and 80. In the case of selector knob 62, four detents correspond to the four selectable modes for providing light of different color and/or intensity from light head 30 and also provide tactile sensation or "feel" regarding the position of selector knob 62. The four detent positions of selector knob 62 are, e.g., "W" for white illumination light from LED 30I, "C" for colored light of the selected one of the three colors of LED 30C, "IR" for IR illumination from LED 30IR, and OFF for LEDs 30I, 30C, 30IR being OFF. Each selectable (and detented) position thereof is indicated by a marking that is raised above the surface of selector knob 62 for providing tactile feel, and the IR marking preferably has a raised border to distinctively mark that selection.

The three detent positions to which IFF selector 80 can be rotated by urging against paddle 84 thereof include a center position at which all of the light sources of light 10 are inhibited from being turned ON, e.g., a "lock out" position, and left and right positions at which the IFF LED is turned ON. Providing right and left IFF ON positions provides ambidexterity to accommodate both right handed and left handed users. These detents also provide tactile feel to the user. Optionally, light 10 may be configured such that the center position of actuator 80 is a position at which all of the light sources of light 10 are inhibited from being turned ON, e.g., a "lock out" position, at which an accidental and/or unintended turning ON of light 10 is avoided.

The detents for the OFF positions of selector knob 62 and IFF actuator 82 may be made stronger than the detents for other positions thereof so as to reduce the likelihood that the light is turned ON unintentionally, e.g., if the actuator is bumped or rests against an object.

Preferably, but optionally, light 10 includes a safety cover 88 as shown in FIGS. 5D and 5E for further reducing the likelihood that the light 10 is turned ON unintentionally. Safety cover 88 is pivoted into a first position, e.g., the illustrated or ON position, to mechanically prevent the paddle actuator 82 of the IFF actuator 80 from being moved to either side of its center position (OFF position) whereat all of the light sources of example light 10 are OFF. Safety cover 88 may be pivoted to a second position, e.g., rearwardly on light 10 to be adjacent to battery cover latch 58, thereby to be clear of IFF paddle 82 which can then be moved to either side to actuate light 10 as described.

An example safety cover 88 has a central or restraining portion 88R that is shaped correspondingly to IFF paddle 82 to enclose IFF paddle 82 when safety cover 88 is moved, e.g., pivoted, to the protective position, thereby to restrain sideways movement of paddle 82. Example restraining portion 88R of safety cover 88 is formed to be three sides of a rectangle to correspond with the upper and two side surfaces of paddle 82 so as to relatively closely fit around paddle 82. Example cover 88 has a pair of arms 88A extending respectively from the opposite ends of central portion 88R and that have respective holes 88H through which the respective ends of battery cover latch 58 pass, so that safety cover 88 is pivotable on battery cover latch 58.

Battery cover latch 58 and safety cover 88 are thereby independently pivotable about an axis defined by the holes in light body 20 in which the respective ends of battery cover latch 58 are disposed. Further, safety cover 88 preferably has one or more detent features 88D, e.g., dimples 88D, that engage corresponding detent features of light body 20 so that safety cover 88 will remain in an ON position whereat it blocks movement of IFF paddle 82 or in an OFF position whereat it does not block paddle 82.

Alternatively or additionally, safety cover 88 may be of a springy material so that the ends of arms 88A thereof press against the light body 20 near where they pivot on the battery latch 58, thereby to provide some frictional resistance to safety cover pivoting absent action by a user thereof. Further, a frictional material and/or surface roughening may provided resistance against movement of safety cover 88 relative to light body 20 absent user action to make it pivot.

ON/OFF actuator 70 comprises a flexible rubber-like boot 72 having an inwardly extending projection that is adjacent to an electrical switch 205 on circuit board 200 so that pressing on boot 72 causes the inward projection thereof to press against and actuate electrical switch 205 on circuit board 200. Preferably the electrical switch 205 responds at a first actuation point where at least a momentary contact closure is made and responds at a second, further, actuation point thereafter where at least a continuous contact closure is made, either mechanically or electronically in response the mechanical contact closure. Preferably electrical switch 205 provides tactile feel to a user to indicate operation of the switch.

Clips 110, 110R, 110B each includes an elongated clip arm 114 and a base end 112 that is substantially perpendicular to clip arm 114 for being attached to the forward end of light body 20, e.g., by a fastener 110F through a hole in base end 112. Distal end 116 of rail clip 110R is formed into a "J" shape so as to engage a feature near the rearward end of light body 20, e.g., a nub or other projection and/or a recess therein, so as to be engaged therewith at both ends, for providing a more secure and reliable attachment of light 10 to a rail, e.g., a helmet rail, through intermediate adapter 120. Spring finger 118 thereof cooperates with adapter 120 on clip 110R to retain light 10 into a desired discrete position of a helmet rail provided by detent features, e.g., detent slots, thereof at which light 10 is retained by fastener 55. Distal end 116' of belt clip 110B is biased to move towards light body 20 and is free to move away therefrom for being placed over a belt, strap, web, pocket, Molle gear, or another object. Clips 110, 110R, 110B are typically, and preferably, of a springy metal, e.g., steel, spring steel, beryllium copper, and the like.

FIG. 6 is a schematic block diagram of the example portable light 10. Operation of light 10 is under the control of a programmable controller 210, e.g., a micro-processor, a micro-controller, a digital signal processor, a field programmable gate array, and the like. Controller 210 responds to signals from plural user operated inputs, e.g., light source selector 60, ON/OFF control 70 and/or IFF selector 80, for providing control signals for causing plural light sources, e.g., illumination light source 30I, one or more color light sources 30C, IR light source 30IR and/or IFF light source 220, to turn ON and OFF. ON/OFF control 70, also referred to as ON/OFF actuator 70 may be provided by contacts of an electrical switch, as may light source selector 60 and IFF selector 80, however, it is preferred that light source selector 60 and IFF selector 80 employ Hall-effect sensors that detect the respective magnets 64M and 84M of actuators 60 and 80 as described. Alternatively, respective magnets 64M and 84M can be detected by respective magnetic reed switches or another detector of a magnetic field.

Processor 210 provides control signals to DC converter and switchable LED drivers 215 which couple electrical power from power source 90, e.g., battery 90, to the respective selected one or ones of the plural light sources, e.g., illumination light source 30I, one or more color light sources 30C, IR light source 30IR and/or IFF light source 220. Feedback representative of the current and/or voltage applied to each of the selected one or ones of the plural light sources is provided by respective current sensors, e.g., resistors or relatively low ohmic value, of the respective LED drivers that are in series with the respective LEDs thereof, and is provided to processor 210 which completes one or more feedback loops for controlling the level of current flowing through the respective LEDs 30I, 30C, 30IR, 220.

Examples of similar DC converters, LED drivers, switchable drivers, and feedback arrangements are described, e.g., in U.S. Pat. No. 7,466,082 entitled "Electronic Circuit Reducing and Boosting Voltage for Controlling LED Current," in U.S. Pat. No. 7,549,766 entitled "Light Including an Electro-Optical Photonic Selector Switch," in U.S. Pat. No. 8,727,561 entitled "Light with Compartment Accommodating Different Batteries," and in U.S. Pat. No. 8,779,683 entitled "Light Having a Circuit Accommodating Batteries of Different Types And/or Sizes," each of which is hereby incorporated herein by reference in its entirety.

In a typical embodiment, light body 20, 20A, 20B, light head housing 32, stalk 42, knob 62, battery cover body 52 and similar parts may be of a metal, e.g., aluminum, brass, magnesium, steel, spring steel, beryllium copper, and the like, or of a plastic, e.g., a nylon, reinforced nylon, engineered nylon, Nylon 6, ABS, polycarbonate, polyethylene, a PC/PET plastic blend, ABS plastic, polypropylene, polystyrene, polyester-polycarbonate blends and ABS polycarbonate blends (such as LEXAN® polycarbonate, XENOY polyester-polycarbonate blend and CYCALOY ABS polycarbonate blend), or may be a thermoplastic nylon or other elastomeric plastic such as that sold under the trademarks CAPRON® and NYPEL® or a thermoplastic elastomer compound or thermoplastic vulcanizate sold under the trademark NYLABOND®, or any other suitable plastic material, with or without a reinforcing material such as a fiberglass, carbon fiber or the like, and with or without a thermally conductive filler material and the like.

Clips 110, 110R, 110B, latch 58, hinge pin and fastener 55, and similar parts may be of a metal, e.g., aluminum, brass, magnesium, steel, spring steel, beryllium copper, and the like. An example of a suitable integrated package containing four LEDS, e.g., white, red, green and blue LEDs, may be an XLamp XQ-E LED which is available from Cree, Inc. located in Durham, N.C., USA.

Optical parts, e.g., reflector/optic 34, IFF lens 64 and the like may be of glass, or any of the foregoing plastics that are optically clear. Resilient and/or flexible parts such as seal 64S, switch actuator boot 72, lens seal 36, and similar parts may be of a rubber or elastomer material, e.g., rubber, neoprene rubber, latex rubber, silicone rubber, Nylabond™ TPE elastomer, SANTOPRENE® elastomer, polyurethane, and like resilient and/or flexible material, and/or an overmolded material.

A portable light 10 and actuator 60, 80 may comprise: a light body 20 having a cavity for receiving a source of electrical power; a light source 30, 220 supported on the light body and including plural light emitting diodes (LEDs) of different types; a signaling light source 220 supported on the light body for producing light having a signal modulated thereon; plural actuators 60, 70, 80 supported on the light body 20 including: a first actuator 60 for selecting a one of the plural LEDs for receiving electrical power; a second actuator 70 for causing the selected one of the plural LEDs of the light source to be coupled to the source of electrical power for producing light; and a third actuator 80 for causing the signaling light source to be coupled to the source of electrical power for producing light. The plural light emitting diodes (LEDs) 30I, 30C of different types may include white, red, blue and green LEDs; or white, red, blue and green LEDs in a common package. The signal modulated on the light produced by the signaling light source 220 may include an identification friend or foe (IFF) signal. The light body 20 may have a hollow cylindrical support thereon and wherein the first and third actuators 60, 80 may comprise: a tapered actuator member having a central cylindrical part that is smaller than an interior of the hollow cylindrical support, having a wider base that is wider than the central cylindrical part thereof and having a narrower tip that is narrower than the central cylindrical part thereof; an actuator ring having an opening that is larger than an exterior of the hollow cylindrical support and having a radial paddle extending outwardly from the actuator ring; a selector knob that is larger than the exterior of the hollow cylindrical support and that has a central opening therein; wherein the central cylindrical part of the tapered actuator member is disposed in the hollow cylindrical support with the wider base within the body and the narrower tip extending from the hollow cylindrical support, whereby the tapered actuator member is rotatable in the hollow cylindrical support; wherein the actuator ring is around the hollow cylindrical support; and wherein the selector knob is disposed on and fastened to the narrower end of the tapered actuator member, whereby the tapered actuator member and the selector knob are captive in and are rotatable together in the hollow cylindrical support, and whereby the actuator ring is captive on and is rotatable around the hollow cylindrical support. The tapered actuator member and the actuator ring may each have raised and/or recessed features thereon, further comprising: a circular wavy spring disposed between the actuator ring and the selector knob with the wavy spring being compressed between the actuator ring and the selector knob to engage the raised and/or recessed features of the tapered actuator member and the actuator ring, whereby rotational detents are provided for the selector knob and for the actuator ring. The tapered actuator member may have a light entry surface at the wider end thereof and a light exit surface at the narrow tip thereof, and have an optically clear path therebetween, wherein the signaling light source is disposed adjacent to the light entry surface of the tapered actuator member. The portable light and actuator may further include a safety cover configured to prevent actuation of the third actuator. The safety cover may be pivotably mounted on the light body and may pivoted to a first position whereat the safety cover mechanically blocks actuation of the third actuator and may be pivoted to a second position whereat the third actuator can be moved to be actuated. The first actuator may have an OFF position whereat the second actuator cannot cause the selected one of the plural LEDs of the light source to be coupled to the source of electrical power for producing light, or the third actuator may have an OFF position whereat the second actuator cannot cause the signaling light source to be coupled to the source of electrical power for producing light; or the first actuator may have an OFF position whereat the second actuator cannot cause the selected one of the plural LEDs of the light source to be coupled to the source of electrical power for producing light and the third actuator may have an OFF position whereat the second actuator cannot cause the signaling light source to be coupled to the source of electrical power for producing light. The signaling light source may produce an identification friend or foe (IFF) signal when coupled to the source of electrical power for producing light. The portable light and actuator wherein: the first actuator includes a magnet, or the third actuator includes a magnet, or the first and third actuators each include a respective magnet; further comprising one or more magnetic field detectors disposed proximate the first and third actuators for detecting the respective positions thereof from the magnetic fields of the respective magnets thereof. The light source supported on the light body may comprise a flexible stalk extending from the light body and a light head on the distal end of the flexible stalk that includes the plural light emitting diodes (LEDs) of different types.

A portable light actuator 60, 80 may comprise: a body 20 having a hollow cylindrical support thereon; a tapered actuator member having a central cylindrical part that is smaller than an interior of the hollow cylindrical support, having a wider base that is wider than the central cylindrical part thereof and having a narrower tip that is narrower than the central cylindrical part thereof; an actuator ring having an opening that is larger than an exterior of the hollow cylindrical support and having a radial paddle extending outwardly from the actuator ring; a selector knob that is larger than the exterior of the hollow cylindrical support and that has a central opening therein; wherein the central cylindrical part of the tapered actuator member is disposed in the hollow cylindrical support with the wider base within the body and the narrower tip extending from the hollow cylindrical support, whereby the tapered actuator member is rotatable in the hollow cylindrical support; wherein the actuator ring is around the hollow cylindrical support; and wherein the selector knob is disposed on and fastened to the narrower end of the tapered actuator member, whereby the tapered actuator member and the selector knob are captive in and are rotatable together in the hollow cylindrical support, and whereby the actuator ring is captive on and is rotatable around the hollow cylindrical support. The tapered actuator member and the actuator ring may each have raised and/or recessed features thereon, and the rotatable actuator assembly may further comprise: a circular wavy spring disposed between the actuator ring and the selector knob with the wavy spring being compressed between the actuator ring and the selector knob to engage the raised and/or recessed features of the tapered actuator member and the actuator ring, whereby rotational detents are provided for the selector knob and for the actuator ring. The tapered actuator member may have a light entry surface at the wider end thereof and a light exit surface at the narrow tip thereof, and an optically clear path therebetween, further comprising: a light source adjacent to the light entry surface of the tapered actuator member. The light source adjacent to the light entry surface of the tapered actuator member may produce an identification friend or foe (IFF) signal. The portable light actuator may further include a safety cover configured to prevent movement of the actuator ring. The portable light and actuator of claim 1 wherein: the tapered actuator member includes a magnet, or the actuator ring includes a magnet, or the tapered actuator member and the actuator ring each include a respective magnet; further comprising one or more magnetic field detectors disposed proximate the tapered actuator member and/or the actuator ring for detecting the respective positions thereof from the magnetic fields of the respective magnets thereof. The portable light actuator may further comprise: a light body having a cavity for receiving a source of electrical power; a light source supported on the light body and including plural light emitting diodes (LEDs) of different types; a signaling light source supported adjacent the tapered actuator member for producing light having a signal modulated thereon; wherein the tapered actuator member and the selector knob provide an actuator for selecting a one of the plural LEDs for receiving electrical power; wherein the actuator ring provides an actuator for causing the signaling light source to be coupled to the source of electrical power for producing light; and an ON/OFF actuator for causing the selected one of the plural LEDs of the light source to be coupled to the source of electrical power for producing light. The plural light emitting diodes (LEDs) of different types may include: white, red, blue and green LEDs; or white, red, blue and green LEDs in a common package. The portable light actuator may further comprise a safety cover pivotably mounted on the light body and pivotable to a first position whereat the safety cover mechanically blocks actuation of the actuator ring and pivotable to a second position whereat the actuator ring can be moved to be actuated. The tapered actuator member and selector knob may have an OFF position whereat the ON/OFF actuator cannot cause the selected one of the plural LEDs of the light source to be coupled to the source of electrical power for producing light, or the actuator ring may have an OFF position whereat the ON/OFF actuator cannot cause the signaling light source to be coupled to the source of electrical power for producing light; or the tapered actuator member may have an OFF position whereat the ON/OFF actuator cannot cause the selected one of the plural LEDs of the light source to be coupled to the source of electrical power for producing light and the actuator ring may have an OFF position whereat the ON/OFF actuator cannot cause the signaling light source to be coupled to the source of electrical power for producing light. The light source supported on the light body may comprise a flexible stalk extending from the light body and a light head on the distal end of the flexible stalk that includes the plural light emitting diodes (LEDs) of different types.

A method for assembling a portable light actuator 60, 80 may comprise: obtaining a body 20 having a hollow cylindrical support thereon; obtaining a tapered actuator member having a central cylindrical part that is smaller than an interior of the hollow cylindrical support, having a wider base that is wider than the central cylindrical part thereof and having a narrower tip that is narrower than the central cylindrical part thereof; obtaining an actuator ring having an opening that is larger than an exterior of the hollow cylindrical support and having a radial paddle extending outwardly from the actuator ring; obtaining a selector knob that is larger than the exterior of the hollow cylindrical support and that has a central opening therein; inserting the central cylindrical part of the tapered actuator member into the hollow cylindrical support with the wider base within the body and the narrower tip extending from the hollow cylindrical support, whereby the tapered actuator member is rotatable in the hollow cylindrical support; placing the actuator ring around the hollow cylindrical support; and placing the selector knob onto the narrower end of the tapered actuator member; and fastening the selector knob to the narrower end of the tapered actuator member, whereby the tapered actuator member and the selector knob are captive in and are rotatable together in the hollow cylindrical support, and whereby the actuator ring is captive on and is rotatable around the hollow cylindrical support. The tapered actuator member and the actuator ring may each have raised and/or recessed features thereon, and the method may further comprise: disposing a circular wavy spring between the actuator ring and the selector knob with the wavy spring being compressed between the actuator ring and the selector knob to engage the raised and/or recessed features of the tapered actuator member and the actuator ring, whereby rotational detents are provided for the selector knob and for the actuator ring. The tapered actuator member may have a light entry surface at the wider end thereof and a light exit surface at the narrow tip thereof, and may have an optically clear path therebetween, and the method may further comprise: providing a light source adjacent to the light entry surface of the tapered actuator member. The providing a light source adjacent to the light entry surface of the tapered actuator member may include providing a light source that produces an identification friend or foe (IFF) signal. The method may further comprise: providing a magnet in the tapered actuator member, or providing a magnet in the actuator ring, or providing respective magnets in the tapered actuator member and the actuator ring; and providing one or more magnetic field detectors disposed proximate the tapered actuator member and/or the actuator ring for detecting the respective positions thereof from magnetic fields of the respective magnets thereof.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "front," "back," "rear," "side," "end," "top," "bottom," "up," "down," "left," "right," "upward," "downward," "forward," "backward," "under" and/or "over," "vertical," "horizontal," and the like may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

As used herein, the term "and/or" encompasses both the conjunctive and the disjunctive cases, so that a phrase in the form "A and/or B" encompasses "A" or "B" or "A and B." In addition, the term "at least one of" one or more elements is intended to include one of any one of the elements, more than one of any of the elements, and two or more of the elements up to and including all of the elements, and so, e.g., the phrase in the form "at least one of A, B and C" includes "A," "B," "C," "A and B," "A and C," "B and C," and "A and B and C."

A fastener as used herein may include any fastener or other fastening device that may be suitable for the described use, including threaded fasteners, e.g., bolts, screws and driven fasteners, as well as pins, rivets, nails, spikes, barbed fasteners, clips, clamps, nuts, speed nuts, cap nuts, acorn nuts, and the like. Where it is apparent that a fastener would be removable in the usual use of the example embodiment described herein, then removable fasteners would be preferred in such instances. A fastener may also include, where appropriate, other forms of fastening such as a formed head, e.g., a peened or heat formed head, a weld, e.g., a heat weld or ultrasonic weld, a braze, and adhesive, and the like.

As used herein, the terms "connected" and "coupled" as well as variations thereof may or may not be intended to be exact synonyms, but may also encompass some similar things and some different things. The term "connected" as indicated by its context may be used generally to refer to elements that have a direct electrical and/or physical contact to each other, whereas the term "coupled" as indicated by its context may be used generally to refer to elements that have an indirect electrical and/or physical contact with each other, e.g., via one or more intermediate elements, so as to cooperate and/or interact with each other, and may include elements in direct contact as well.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable or other device. Such devices could include power sources including, but not limited to, fuel cells, super capacitors, solar cells, and the like. Any of the foregoing may be intended for a single use or for being rechargeable or for both, and/or plural ones thereof may be combined into a battery pack or battery assembly.

While the present invention has been described in terms of the foregoing example embodiments, variations within the scope and spirit of the present invention as defined by the claims following will be apparent to those skilled in the art. For example, light 10 may include a greater or lesser number different light sources and/or may include different actuators therefor and/or uses of the described actuators.

While certain features may be described as a raised feature, e.g., a ridge, boss, flange, projection, detent, or other raised feature, such feature may be positively formed or may be what remains after a recessed feature, e.g., a groove, slot, hole, indentation, recess, detent, or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made. In addition, where a raised feature engages a recessed feature, such as a cylindrical projection that engages a complementary receptacle, the relative positions of the raised and recessed features may be interchanged or other wise modified.

Each of the U.S. Provisional Applications, U.S. patent applications, and/or U.S. patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light and actuator comprising:

a light body having a cavity for receiving a source of electrical power;

a light source supported on the light body and including plural light emitting diodes (LEDs) of different types;

a signaling light source supported on the light body for producing light having a signal modulated thereon;

plural actuators supported on the light body including:

a first actuator that is rotatable on the light body for selecting a one of the plural LEDs for receiving electrical power;

a second actuator for causing the selected one of the plural LEDs of the light source to be coupled to the source of electrical power for producing light; and a third actuator for causing the signaling light source to be coupled to the source of electrical power for producing light, wherein the light produced by the signaling light source is emitted through the rotatable first actuator.

2. The portable light and actuator of claim 1 wherein the plural light emitting diodes (LEDs) of different types include:

white, red, blue and green LEDs; or white, red, blue and green LEDs in a common package.

3. The portable light and actuator of claim 1 wherein the signal modulated on the light produced by the signaling light source includes an identification friend or foe identification.

4. The portable light and actuator of claim 1 further including a safety cover configured to prevent actuation of the third actuator.

5. The portable light and actuator of claim 4 wherein the safety cover is pivotably mounted on the light body and is pivotable to a first position whereat the safety cover mechanically blocks actuation of the third actuator and is pivotable to a second position whereat the third actuator can be moved to be actuated.

6. The portable light and actuator of claim 1 wherein:

the first actuator has an OFF position whereat the second actuator cannot cause the selected one of the plural LEDs of the light source to be coupled to the source of electrical power for producing light, or the third actuator has an OFF position whereat the second actuator cannot cause the signaling light source to be coupled to the source of electrical power for producing light; or the first actuator has an OFF position whereat the second actuator cannot cause the selected one of the plural LEDs of the light source to be coupled to the source of electrical power for producing light and the third actuator has an OFF position whereat the second actuator cannot cause the signaling light source to be coupled to the source of electrical power for producing light.

7. The portable light and actuator of claim 1 wherein the signaling light source produces an identification friend or foe (IFF) signal when coupled to the source of electrical power for producing light.

8. The portable light and actuator of claim 1 wherein: the first actuator includes a magnet, or the third actuator includes a magnet, or the first and third actuators each include a respective magnet; further comprising one or more magnetic field detectors disposed proximate the first and third actuators for detecting the respective positions thereof from magnetic fields of the respective magnets thereof.

9. The portable light and actuator of claim 1 wherein the light source supported on the light body comprises a flexible stalk extending from the light body and a light head on the distal end of the flexible stalk that includes the plural light emitting diodes (LEDs) of different types.

10. A portable light and actuator comprising:

a light body having a cavity for receiving a source of electrical power;

a light source supported on the light body and including plural light emitting diodes (LEDs) of different types;

a signaling light source supported on the light body for producing light having a signal modulated thereon;

plural actuators supported on the light body including:

a first actuator for selecting a one of the plural LEDs for receiving electrical power;

a second actuator for causing the selected one of the plural LEDs of the light source to be coupled to the source of electrical power for producing light; and a third actuator for causing the signaling light source to be coupled to the source of electrical power for producing light, wherein the light body has a hollow cylindrical support thereon and wherein the first and third actuators comprise:

a tapered actuator member having a central cylindrical part that is smaller than an interior of the hollow cylindrical support, having a wider base that is wider than the central cylindrical part thereof and having a narrower tip that is narrower than the central cylindrical part thereof;

an actuator ring having an opening that is larger than an exterior of the hollow cylindrical support and having a radial paddle extending outwardly from the actuator ring;

a selector knob that is larger than the exterior of the hollow cylindrical support and that has a central opening therein;

wherein the central cylindrical part of the tapered actuator member is disposed in the hollow cylindrical support with the wider base within the body and the narrower tip extending from the hollow cylindrical support, whereby the tapered actuator member is rotatable in the hollow cylindrical support;

wherein the actuator ring is around the hollow cylindrical support; and wherein the selector knob is disposed on and fastened to the narrower end of the tapered actuator member, whereby the tapered actuator member and the selector knob are captive in and are rotatable together in the hollow cylindrical support, and whereby the actuator ring is captive on and is rotatable around the hollow cylindrical support.

11. The portable light and actuator of claim 10 wherein the tapered actuator member and the actuator ring each have raised and/or recessed features thereon, further comprising:

a circular wavy spring disposed between the actuator ring and the selector knob with the wavy spring being compressed between the actuator ring and the selector knob to engage the raised and/or recessed features of the tapered actuator member and the actuator ring, whereby rotational detents are provided for the selector knob and for the actuator ring.

12. The portable light and actuator of claim 10 wherein the tapered actuator member has a light entry surface at the wider end thereof and a light exit surface at the narrow tip thereof, and has an optically clear path therebetween, wherein the signaling light source is disposed adjacent to the light entry surface of the tapered actuator member.

13. A portable light actuator comprising:

a body having a hollow cylindrical support thereon;

a tapered actuator member having a central cylindrical part that is smaller than an interior of the hollow cylindrical support, having a wider base that is wider than the central cylindrical part thereof and having a narrower tip that is narrower than the central cylindrical part thereof;

an actuator ring having an opening that is larger than an exterior of the hollow cylindrical support and having a radial paddle extending outwardly from the actuator ring;

a selector knob that is larger than the exterior of the hollow cylindrical support and that has a central opening therein;

wherein the central cylindrical part of the tapered actuator member is disposed in the hollow cylindrical support with the wider base within the body and the narrower tip extending from the hollow cylindrical support, whereby the tapered actuator member is rotatable in the hollow cylindrical support;

wherein the actuator ring is around the hollow cylindrical support; and wherein the selector knob is disposed on and fastened to the narrower end of the tapered actuator member, whereby the tapered actuator member and the selector knob are captive in and are rotatable together in the hollow cylindrical support, and whereby the actuator ring is captive on and is rotatable around the hollow cylindrical support.

14. The portable light actuator of claim 13 wherein the tapered actuator member and the actuator ring each have raised and/or recessed features thereon, further comprising:

a circular wavy spring disposed between the actuator ring and the selector knob with the wavy spring being compressed between the actuator ring and the selector knob to engage the raised and/or recessed features of the tapered actuator member and the actuator ring, whereby rotational detents are provided for the selector knob and for the actuator ring.

15. The portable light actuator of claim 13 wherein the tapered actuator member has a light entry surface at the wider end thereof and a light exit surface at the narrow tip thereof, and has an optically clear path therebetween, further comprising: a light source adjacent to the light entry surface of the tapered actuator member.

16. The portable light actuator of claim 15 wherein the light source adjacent to the light entry surface of the tapered actuator member produces an identification friend or foe (IFF) signal.

17. The portable light actuator of claim 13 further including a safety cover configured to prevent movement of the actuator ring.

18. The portable light and actuator of claim 13 wherein: the tapered actuator member includes a magnet, or the actuator ring includes a magnet, or the tapered actuator member and the actuator ring each include a respective magnet; further comprising one or more magnetic field detectors disposed proximate the tapered actuator member and/or the actuator ring for detecting the respective positions thereof from magnetic fields of the respective magnets thereof.

19. The portable light actuator of claim 13 further comprising:

a light body having a cavity for receiving a source of electrical power;

a light source supported on the light body and including plural light emitting diodes (LEDs) of different types;

a signaling light source supported adjacent the tapered actuator member for producing light having a signal modulated thereon;

wherein the tapered actuator member and the selector knob provide an actuator for selecting a one of the plural LEDs for receiving electrical power;

wherein the actuator ring provides an actuator for causing the signaling light source to be coupled to the source of electrical power for producing light; and an ON/OFF actuator for causing the selected one of the plural LEDs of the light source to be coupled to the source of electrical power for producing light.

20. The portable light actuator of claim 19 wherein the plural light emitting diodes (LEDs) of different types include:

white, red, blue and green LEDs; or white, red, blue and green LEDs in a common package.

21. The portable light actuator of claim 19 further comprising a safety cover pivotably mounted on the light body and is pivotable to a first position whereat the safety cover mechanically blocks actuation of the actuator ring and is pivotable to a second position whereat the actuator ring can be moved to be actuated.

22. The portable light actuator of claim 19 wherein:

the tapered actuator member and selector knob have an OFF position whereat the ON/OFF actuator cannot cause the selected one of the plural LEDs of the light source to be coupled to the source of electrical power for producing light, or the actuator ring has an OFF position whereat the ON/OFF actuator cannot cause the signaling light source to be coupled to the source of electrical power for producing light; or the tapered actuator member has an OFF position whereat the ON/OFF actuator cannot cause the selected one of the plural LEDs of the light source to be coupled to the source of electrical power for producing light and the actuator ring has an OFF position whereat the ON/OFF actuator cannot cause the signaling light source to be coupled to the source of electrical power for producing light.

23. The portable light actuator of claim 19 wherein the light source supported on the light body comprises a flexible stalk extending from the light body and a light head on the distal end of the flexible stalk that includes the plural light emitting diodes (LEDs) of different types.

24. A method for assembling a portable light actuator comprising:

obtaining a body having a hollow cylindrical support thereon;

obtaining a tapered actuator member having a central cylindrical part that is smaller than an interior of the hollow cylindrical support, having a wider base that is wider than the central cylindrical part thereof and having a narrower tip that is narrower than the central cylindrical part thereof;

obtaining an actuator ring having an opening that is larger than an exterior of the hollow cylindrical support and having a radial paddle extending outwardly from the actuator ring;

obtaining a selector knob that is larger than the exterior of the hollow cylindrical support and that has a central opening therein;

inserting the central cylindrical part of the tapered actuator member into the hollow cylindrical support with the wider base within the body and the narrower tip extending from the hollow cylindrical support, whereby the tapered actuator member is rotatable in the hollow cylindrical support;

placing the actuator ring around the hollow cylindrical support; and placing the selector knob onto the narrower end of the tapered actuator member; and fastening the selector knob to the narrower end of the tapered actuator member, whereby the tapered actuator member and the selector knob are captive in and are rotatable together in the hollow cylindrical support, and whereby the actuator ring is captive on and is rotatable around the hollow cylindrical support.

25. The method of claim 24 wherein the tapered actuator member and the actuator ring each have raised and/or recessed features thereon, the method further comprising:

disposing a circular wavy spring between the actuator ring and the selector knob with the wavy spring being compressed between the actuator ring and the selector knob to engage the raised and/or recessed features of the tapered actuator member and the actuator ring, whereby rotational detents are provided for the selector knob and for the actuator ring.

26. The method of claim 24 wherein the tapered actuator member has a light entry surface at the wider end thereof and a light exit surface at the narrow tip thereof, and has an optically clear path therebetween, the method further comprising: providing a light source adjacent to the light entry surface of the tapered actuator member.

27. The method of claim 26 wherein the providing a light source adjacent to the light entry surface of the tapered actuator member includes providing a light source that produces an identification friend or foe (IFF) signal.

28. The method of claim 24 further comprising:

providing a magnet in the tapered actuator member, or providing a magnet in the actuator ring, or providing respective magnets in the tapered actuator member and the actuator ring;

and providing one or more magnetic field detectors disposed proximate the tapered actuator member and/or the actuator ring for detecting the respective positions thereof from magnetic fields of the respective magnets thereof.

* * * * *